US006557477B1

(12) United States Patent
Degutis et al.

(10) Patent No.: US 6,557,477 B1
(45) Date of Patent: May 6, 2003

(54) RING PROTECTOR FOR PREVENTING TAMPERING OF VALVES POSITIONED INSIDE A RAILCAR DOME

(75) Inventors: Alex V. Degutis, East Chicago, IN (US); Andrew C. Crouse, Woodridge, IL (US)

(73) Assignee: Salco Products, Inc., Lemont, IL (US)

( * ) Notice: Subject to any disclaimer, the term of this patent is extended or adjusted under 35 U.S.C. 154(b) by 0 days.

(21) Appl. No.: 10/162,153

(22) Filed: Jun. 4, 2002

(51) Int. Cl.[7] ..... B61D 5/00
(52) U.S. Cl. ..... 105/358
(58) Field of Search ..... 105/238.1, 355, 105/358, 360, 396, 404; 220/694, 724, 726, 730; 137/343, 347, 350

(56) References Cited

U.S. PATENT DOCUMENTS

| | | | |
|---|---|---|---|
| 5,386,845 | A | 2/1995 | Zink |
| 5,673,897 | A | 10/1997 | Crochet et al. |
| 6,227,223 | B1 | 5/2001 | Crochet et al. |

*Primary Examiner*—S. Joseph Morano
*Assistant Examiner*—Robert J. McCarry, Jr.
(74) *Attorney, Agent, or Firm*—Jenner & Block, LLC

(57) ABSTRACT

A ring protector for preventing unauthorized access through the dome port openings of a railcar dome. The ring protector defines a plurality of approximately equally spaced holes. The ring protector has an opened position in which each of the dome port openings is in-line with one of the access holes and a closed position in which each of the port openings is not in-line with one of the access holes. The ring protector is adapted to be rotatable from the opened position to the closed position.

20 Claims, 7 Drawing Sheets

RING PROTECTOR FOR PREVENTING TAMPERING OF VALVES POSITIONED INSIDE A RAILCAR DOME

BACKGROUND OF THE INVENTION

The present invention relates to a ring protector. More specifically, it relates to a ring protector for preventing tampering of valves positioned inside a railcar dome.

Valves and actuators for tanker railway cars are subject to severe limitations due to standards imposed by various governing bodies, such as the Chlorine Institute and the Association of American Railroads. For instance, a valve/actuator combination must be attachable to the industry standard manway cover which covers the openings in the tanker railcar. A standard railcar 10 having a manway cover 12 is illustrated in FIG. 1. The standard manway cover 12 provides for the attachments of four valves 14, including two valves for liquids and two valves for vapors. Furthermore, all four valves 14 must fit within the confines of a dome 16 covering the manway cover 12. While the prior art dome illustrated in FIG. 1 has four valves, other prior art domes exist with three or five valves.

A sectional view of a standard dome 16 is illustrated in FIG. 2 and a top view of the standard dome 16 is illustrated in FIG. 3. The dome 16 covers and protects the valves 14 placed therein. The dome 16 includes a dome ring 18 surrounding the valves 14 and a convex dome lid 20 overlaying the dome ring 18. As seen in FIG. 3, a plurality of circumferentially and equally spaced bolts 22 attach the dome 16 to the manway cover 12. The dome ring 18 defines four approximately equally spaced dome port openings 24. The dome port openings 24 allow restricted access to the valves 14 positioned inside the dome 16 without removing the dome. The Association of American Railroads provides guidelines for the sizes of both the dome and the dome port openings. The actual sizes of the dome and the dome port openings are normally specified by the car builders based on the guidelines provided the Association of American Railroads.

While the dome port openings 24 provide the convenience of having access to the valves 14 without having to remove the dome 16, the dome port openings 24 also allow moisture to enter into the dome 16 and an unauthorized person to tamper with the valves 14. Such tampering of the valves 14 may release hazardous vapors, such as chlorine, into the atmosphere. To prevent moisture from entering the dome 16, one solution is to mount four rotatable circular plate 26 on the outer surface of the dome ring 18. Each plate 26 is mounted adjacent to a dome port opening 24 such that the plate 26 can be rotated to an opened position in which the plate 26 does not block the dome port opening 24. To prevent moisture from entering the dome 16 through the dome port opening 24, the plate 26 can be rotated to a closed position in which the plate 26 completely blocks the dome port opening 24 as illustrated in FIG. 4. While such prior art circular plates 26 can prevent moisture from entering the dome 16 through the dome port openings 24, the plates 26 cannot prevent an unauthorized person from tampering with the valves 14. Therefore, there exists a need for assuring that the dome port openings remain blocked when authorized access to the valves are not required.

DETAILED DESCRIPTION OF THE DRAWINGS

Figures 1, 2:
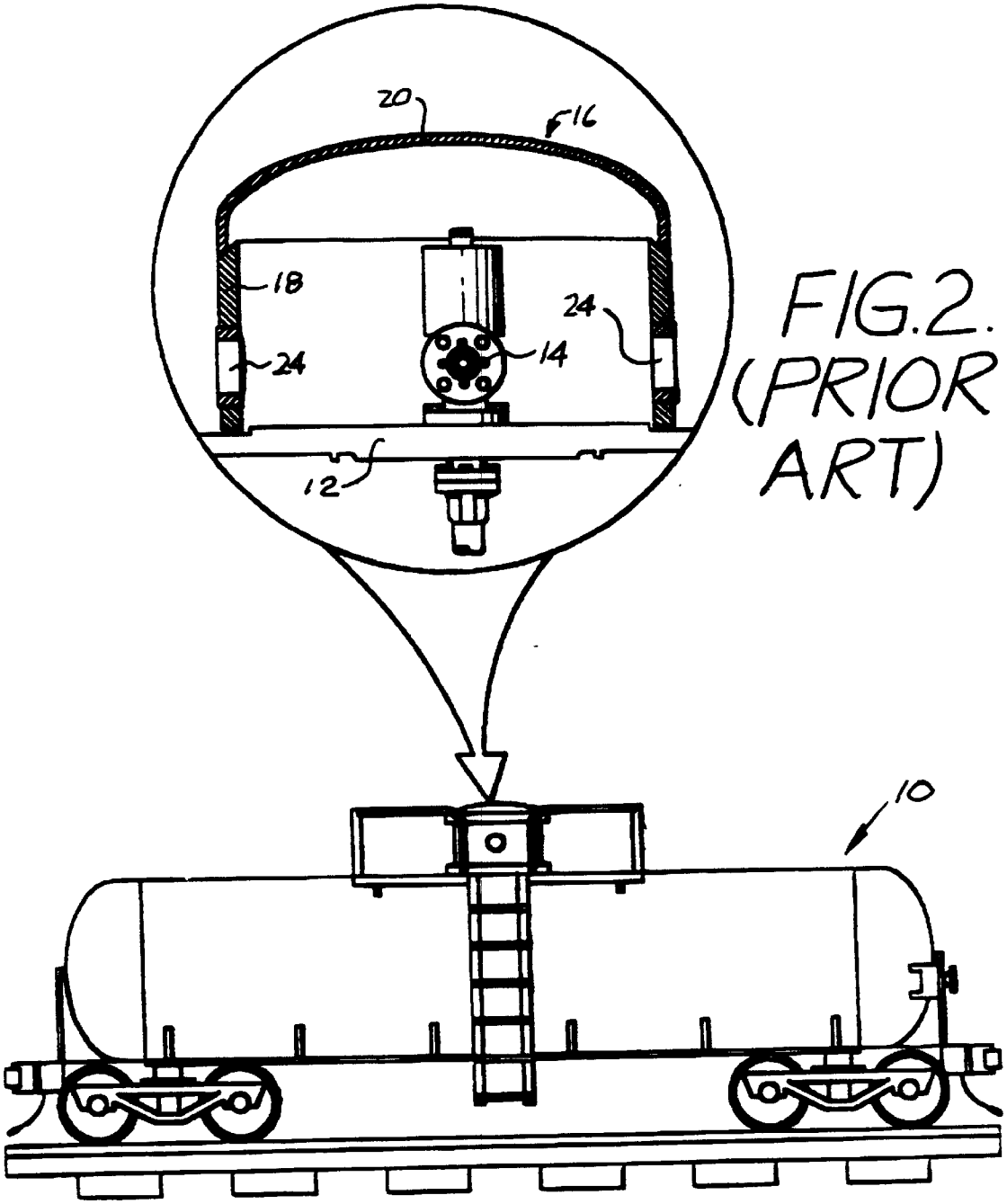
FIG.2. (PRIOR ART)
FIG.1. (PRIOR ART)
FIG. 1 is a side view of a tanker railcar with a prior art dome attached.
FIG. 2 is a sectional view of the prior art dome of FIG. 1.
Figure 3:
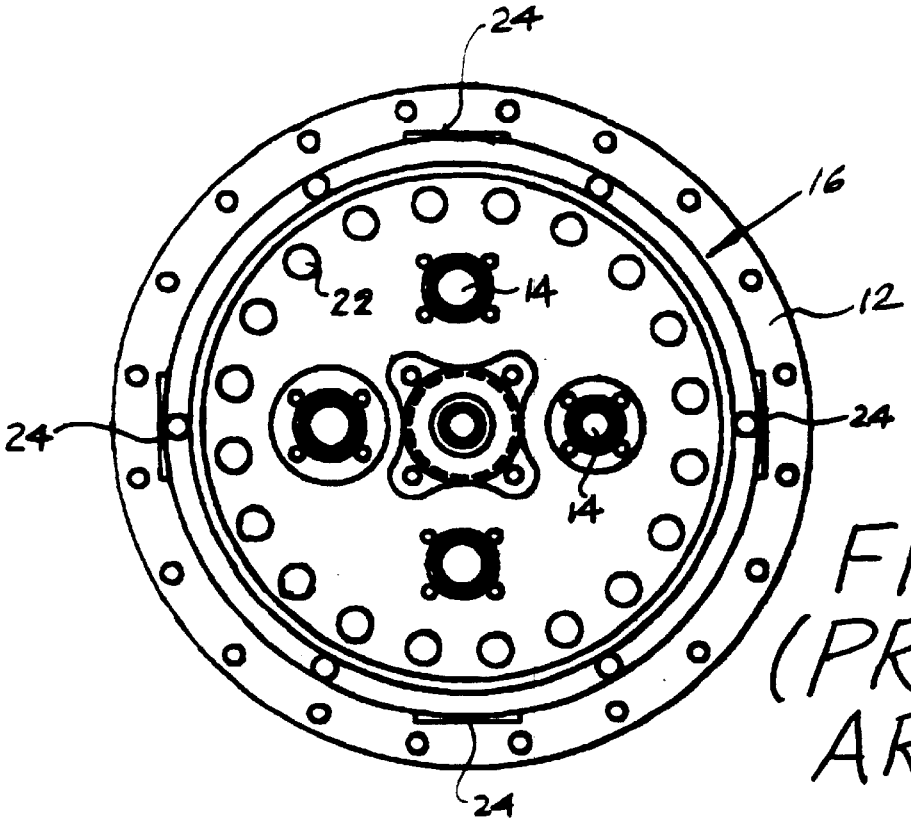
FIG. 3. (PRIOR ART)
FIG. 3 is top view of the prior art dome of FIG. 1.
Figure 4:
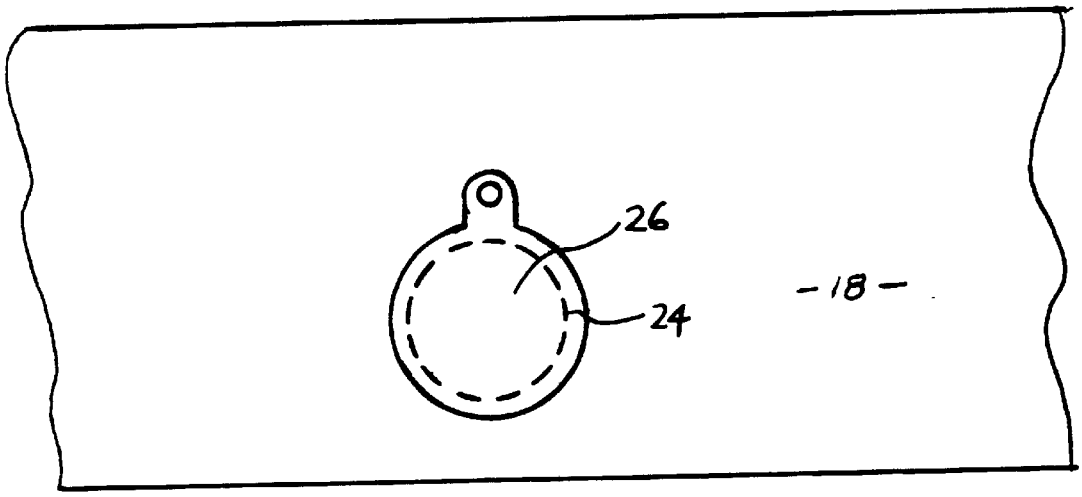
FIG. 4. (PRIOR ART)
FIG. 4 is a prior art rotatable circular plate mounted to the outer surface of the dome to block the dome port opening.
Figure 5:
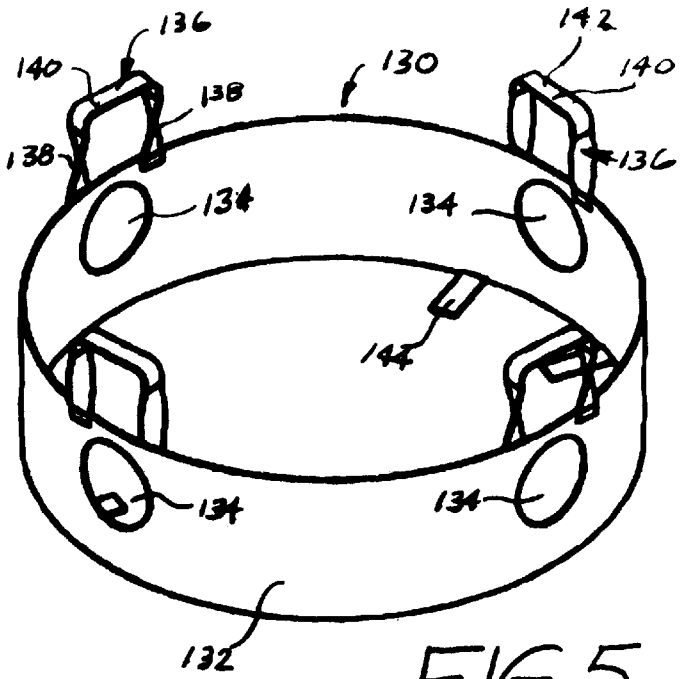
FIG. 5 is a perspective view of a ring protector in accordance to the present invention for preventing unauthorized access through the dome port opening.
Figure 6:
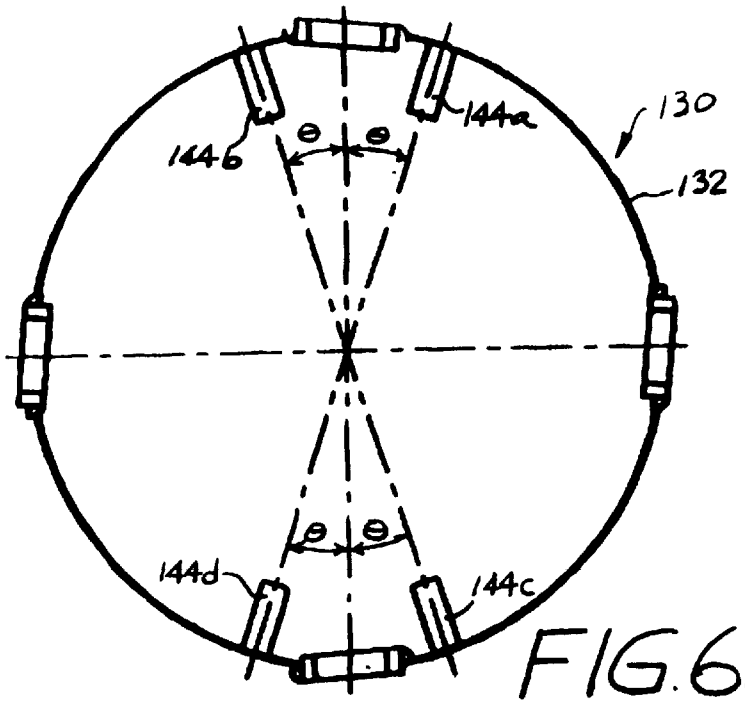
FIG. 6 is a top view of the ring protector of FIG. 5.
Figure 7:
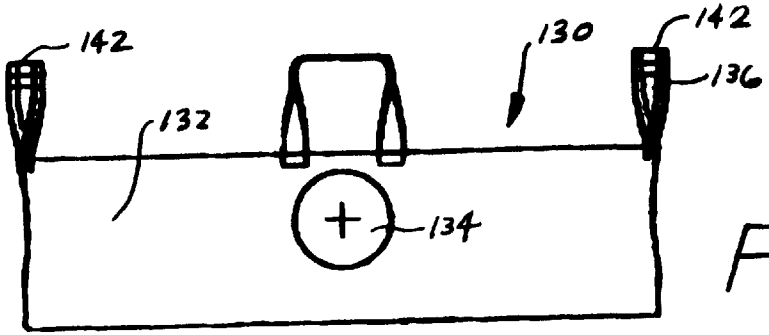
FIG. 7 is a side of the ring protector of FIG. 5.

FIGS. 5–12 illustrate a ring protector 130 in accordance to the present invention for preventing unauthorized access through a dome port opening of a railcar dome.

As illustrated in FIGS. 5–8, the ring protector 130 has an approximately cylindrical ring body 132. The ring body 132 is sized such that the outer diameter of the ring body is slightly less than the inner diameter of the dome ring 118. For this embodiment, the ring protector 132 defines four approximately equally spaced access holes 134. While this embodiment illustrates the ring protector as defining four access holes, the number of access holes could be different to match the number of dome port opening of the particular railcar dome in which the ring protector is to be situated within. The diameter of each access hole 134 is approximately equal or slightly larger than the diameter of the dome port openings 124 defined in the dome ring 118. The distance from the bottom of the ring protector 130 to the mid-point of each access hole 134 is approximately equal to the distance from the plane defined by the upper surface of manway cover 112, for which the ring protector 130 is to be situated upon, to the mid-point of dome port openings 124. Such size and location of the access holes 134 allow each of dome port openings 124 to be approximately in-line with one of the access holes 134 when the ring protector 130 is positioned in an opened position. The ring protector 130 can be rotated from the opened position to a closed position in which each of the dome port openings 124 is not in-line with one of the access holes 134. Therefore at the closed position, the ring protector 130 completely blocks each dome port opening 124.

Four approximately equally spaced handles 136 extend from the upper edge of the ring body 132. While not a necessary feature, for this embodiment, each handle 136 is located approximately directly on top of an access hole 134.

Alternatively, the access holes can be offset from the handles by a certain amount to match the offset between the dome port openings and the pivot point of the dome lid of the particular railcar dome in which the ring protector is to be situated within. Each handle 136 comprises two leg portions 138 and a flat grip portion 140 connecting the two leg portions 138. The top surface of the grip portion 140 also acts an abutment surface 142. The abutment surface 142 is located a given distance from the upper edge of the ring body 132 and its purpose will be later explained.

Figure 8:
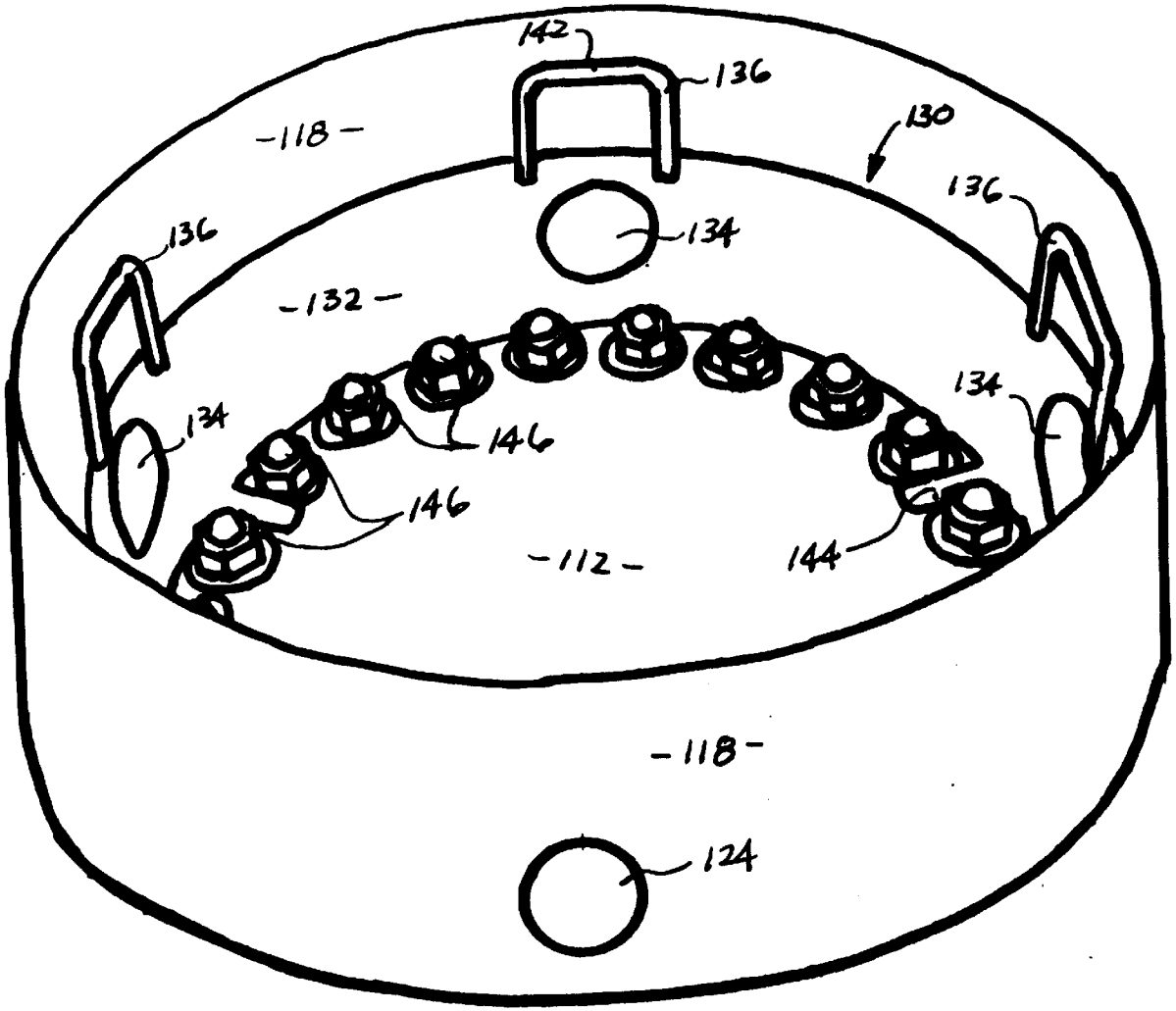
FIG. 8 is a perspective view of the ring protector of FIG. 5 as situated within a dome.
Figure 10:
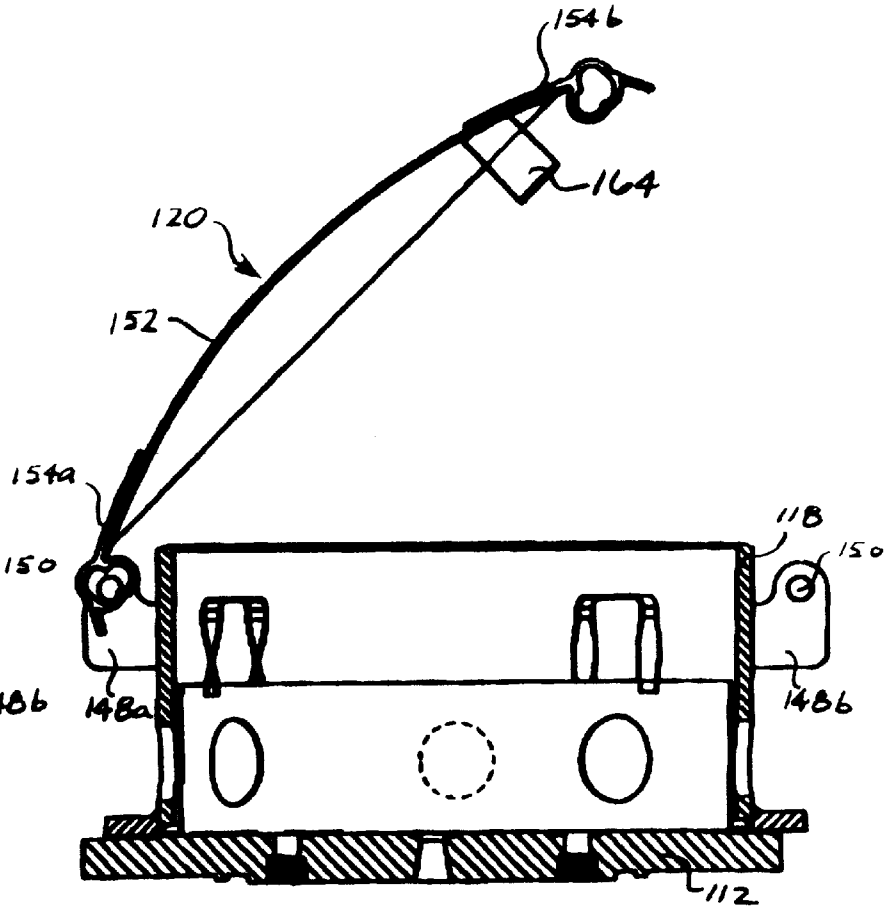
FIG. 10 is a sectional view of the dome and ring protector of FIG. 9 with the ring protector sit the closed position and the dome lid in the opened position.
Figure 9:
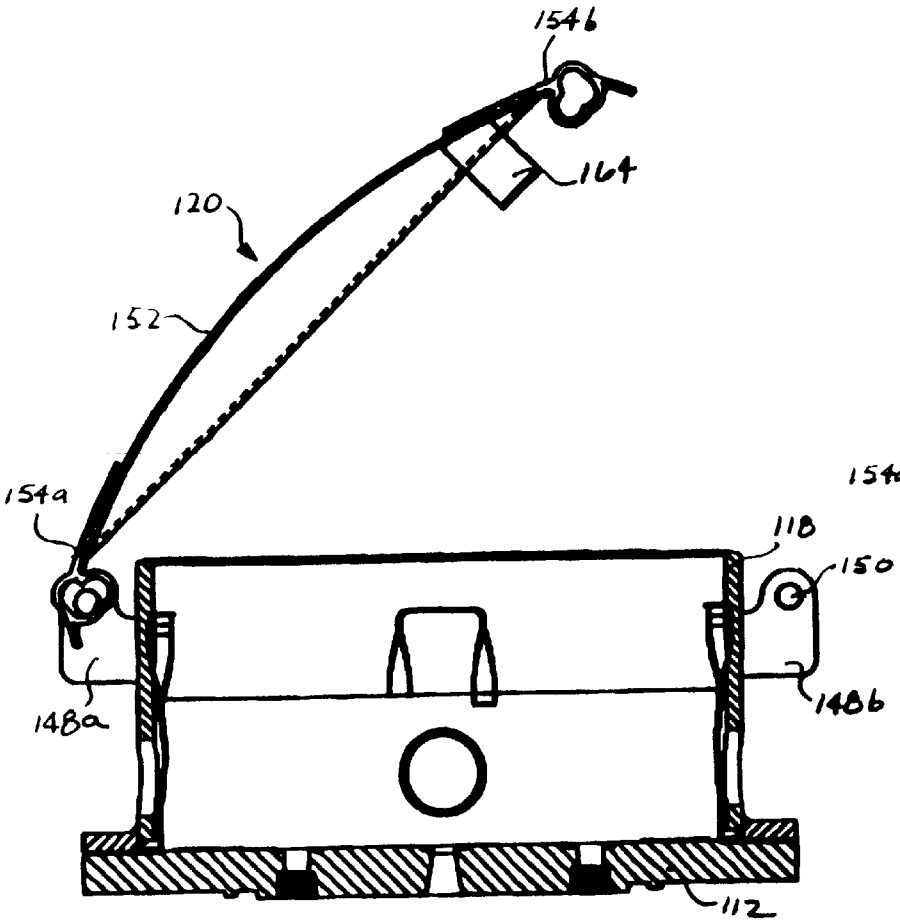
FIG. 9 is a sectional view of a dome in accordance to the present invention with the ring protector of FIG. 5 situated in the opened position and the dome lid in the opened position.

Two pairs of tabs 144 extend radially inwardly from the bottom of the ring body 132. The tabs 144*a*, 144*b* of the first pair of tabs are located a given and opposite angle θ from an access holes. For instance, one tab 144*a* of the first pair is located approximately 18 degrees clockwise from the center-line of an access hole 132 and the other tab 144*b* of the first pair is located approximately 18 degrees counter-clockwise from the center-line of the same access hole 132*a*. The tabs 144*c*, 114*d* of the second pair of tabs are located approximately directly opposite of the first pair of tabs. The given angle θ from the access opening should be such that when the ring protector 130 is positioned in the opened position or in the closed position, the tabs 144 are situated approximately circumferentially midway between two adjacent nuts and bolts 146 used to attach the dome 116 to the manway cover 112 as shown in FIG. 8. The tabs 144 are sized such that when the ring protector 130 is positioned in either the opened position or the closed position, each tab 144 extends beyond the adjacent nuts and bolts 146 so that the terminal end of the tab 144 is located radially inwardly of the circular line define by the nuts and bolts 146 and the width of each tab 144 is slightly narrower than the distance between adjacent the nuts and bolts 146. Such a design of the tabs 144 prevents the ring protector 130 from rotating when it is situated on top of the manway cover 112. To rotate the ring protector 130 from the opened position to the closed position or from the closed position to the opened position, the ring protector 130 must be raised axially away from the manway cover 112 until the tabs 144 are axially outwardly of the terminal ends of the nuts and bolts 146. Once the tabs 144 have cleared the terminal ends of the nuts and bolts 144, the ring protector 130 can be rotated freely to the desired position without the nuts and bolts 146 interfering with the rotation of the ring protector 130.

As illustrated in FIGS. 9–12, two sets of dome ring brackets 148 are attached to the radially outer surface of the dome ring 118. The dome ring brackets 148 are generally L-shaped with a hole 150 defined at the upper end of each bracket 148. One set of dome ring brackets 148*a* functions to retain a pivot pin (not shown) which allows the dome lid 120 to pivot relative to the dome ring 118. The dome lid 120 can be rotated between an opened position and a closed position. The other set of dome ring brackets 148*b* functions to provide the means to latch the dome lid 120 to the dome ring 118 once the dome lid 120 has been rotated to the closed position. While not a necessary feature, for this embodiment, the pivot dome ring brackets 148*a* and the latching dome ring brackets 148b are identical in shape. By using identical brackets, the complexity is reduced and the possibility of using the wrong dome bracket 148 when attaching the bracket to the outer surface of the dome ring 118 or when attaching the dome lid 120 to the dome ring 118 is completely eliminated.

Figure 13:
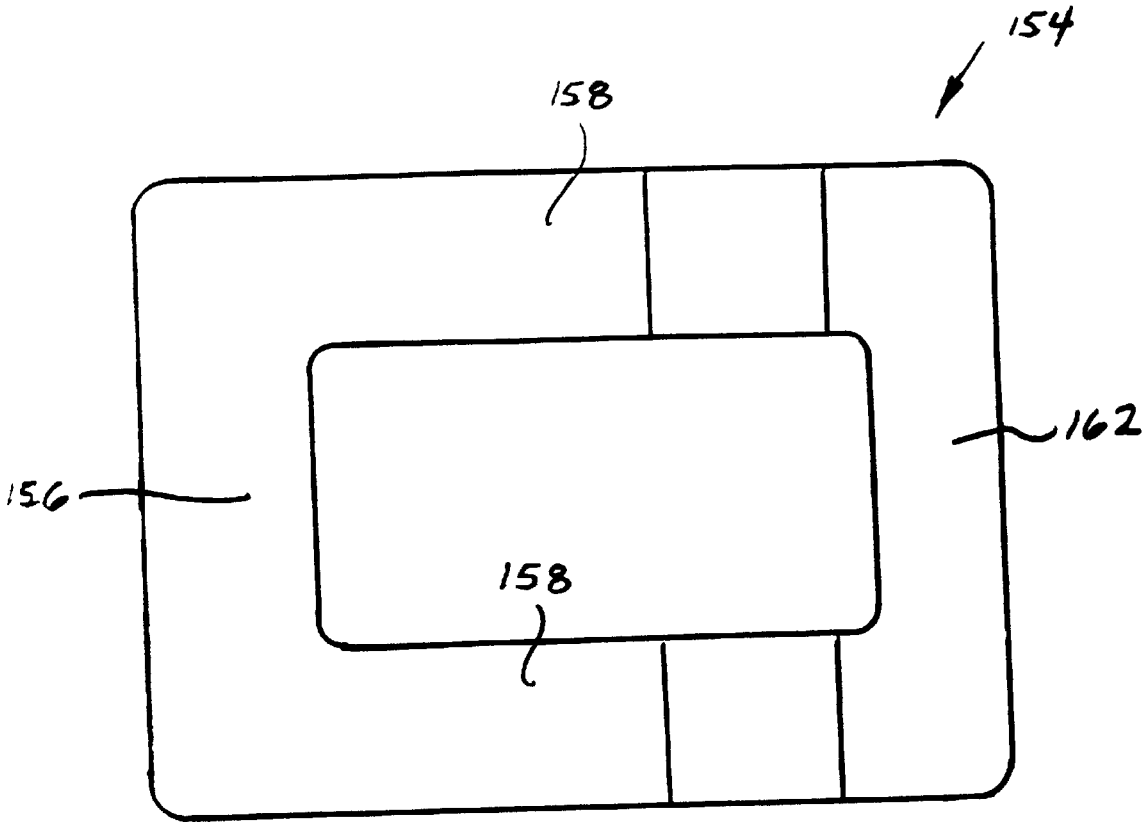
FIG. 13 is a top view of a lid bracket in accordance to the present invention.
Figure 14:
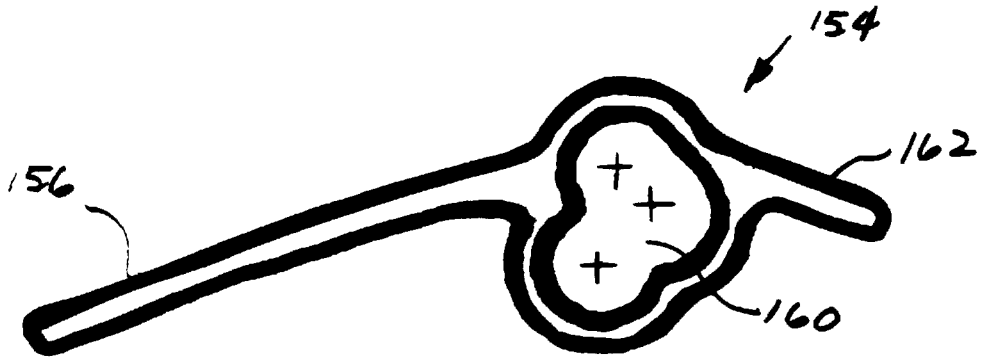
FIG. 14 is a side view of the lid bracket of FIG. 13.

The dome lid 120 has a generally convex body 152. A pivot lid bracket 154*a* and a latching lid bracket 154*b* are attached to opposite ends of the convex body 152. While not a necessary feature, for this embodiment, the pivot lid bracket 154*a* and the latching lid bracket 154*b* are identical in shape. By using identical brackets, the complexity is reduced and the possibility of using the wrong lid bracket 154 when attaching the bracket to the convex body or when attaching the dome lid to the dome ring is completely eliminated. As shown in detail in FIGS. 13 and 14, each lid bracket 154 has a mounting plate 156 allowing the lid bracket 154 to be attached to the upper surface of the convex body 152. A pair of legs 158 extends from the mounting plate 156 in a direction radially outwardly from the convex body 152. Each leg 158 defines a multi-axis hole 160. For this application, a multi-axis hole is defined as a hole having at least two circular axis and is capable of restricting a tubular component to pivot at only one of the circular axis or retaining a tubular component at a circular confines defined by one of the circular axis. The multi-axis hole 160 of this embodiment has three circular axis. The advantage of having a multi-axis hole as compared to a single axis hole, such as circular hole, is that a multi-axis hole allows a pin to be inserted into and retained in a multiple of locations. This feature allows the same lid bracket to be used for different sized domes. The multi-axis hole also has an advantage over a hole having infinite axis, such as a slot. A multi-axis hole is capable of restricting a tubular component to pivot at only one of the circular axis or retaining a tubular component at a circular confines defined by one of the circular axis. However, a tubular component is able to move freely within a infinite-axis hole and not restricted at one particular axial position.

The multi-axis holes 160 are situated such that all the circular axis of one leg 158 are in-line with a corresponding circular axis of the other leg. The legs 158 extends outwardly to a handle 162 connecting the two legs 158. A pivot pin (not shown) is inserted through the holes 160 of pivot dome ring brackets 148 and the multi-axis holes 160 of the lid bracket 154 to pivotably attach the dome lid 120 to the dome ring 118. Once the dome lid 120 is in the closed position, a latch pin (not shown) is inserted through the holes of latching dome ring brackets 148 to prevent the dome lid 120 from pivoting out of the closed position.

Figure 12:
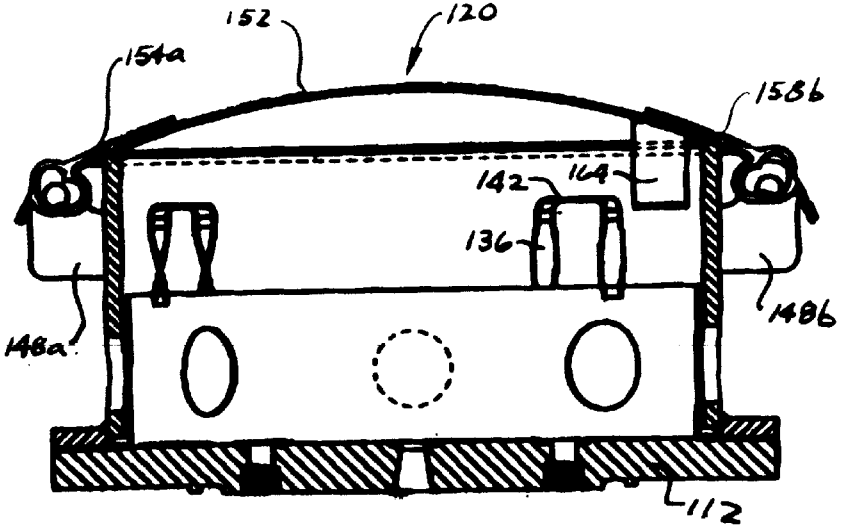
FIG. 12 is a sectional view of the dome and ring protector of FIG. 9 with the ring protector situated in the closed position and the dome lid in the closed position.
Figure 11:
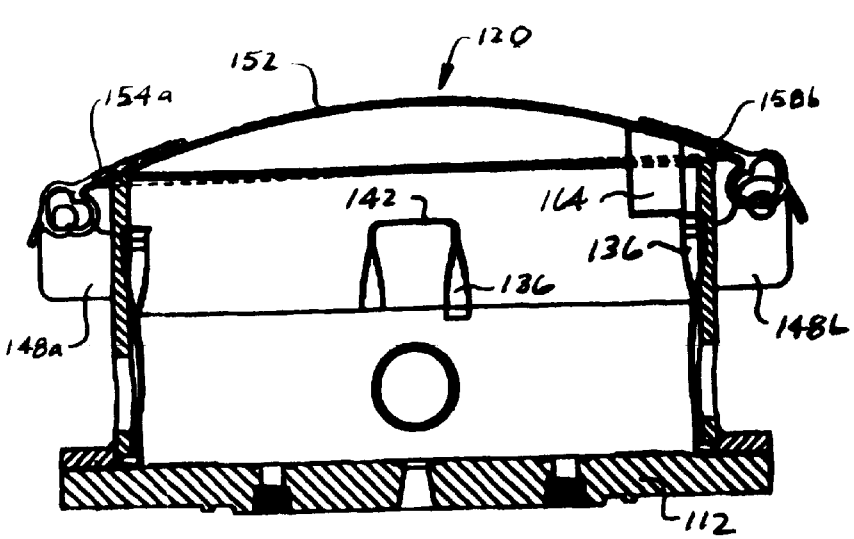
FIG. 11 is a sectional view of the dome and ring protector of FIG. 9 with the ring protector situated in the opened position and the dome lid pivoted toward the closed position.

Referring back to FIGS. 9–12, a verifier 164 is attached to the bottom surface of the dome lid 120. The verifier 164 extends downwardly beyond the abutment surfaces 142 of the handles 136 of the ring protector 130 when the dome lid 120 is in the closed position as shown in FIG. 12. The verifier 164 is located wherein if the ring protector 130 is at the opened position, the terminal end of the verifier 164 abuts the abutment surface 142 of one of the handles 162 to prevent the dome lid 120 from pivoting to the closed position as shown in FIG. 11. Therefore, the verifier 164 assures that ring protector 130 is at the closed position when the dome lid 120 has been pivoted to the closed position.

Various features of the present invention have been described with reference to the above embodiments. It should be understood that modification may be made without departing from the spirit and scope of the invention as represented by the following claims.

What is claimed is:

1. A ring protector for preventing unauthorized access through the dome port openings of a railcar dome, the ring protector defines a plurality of approximately equally spaced access holes, the ring protector has an opened position in which each of the dome port openings is in-line with one of the access holes and a closed position in which each of the port openings is not in-line with one of the access holes, the ring protector is adapted to be rotatable from the opened position to the closed position.

2. The ring protector as claimed in claim 1 wherein the ring protector has a handle extending axially upwardly.

3. The ring protector as claimed in claim 1 wherein the ring protector has a tab extending radially inwardly.

4. The ring protector as claimed in claim 2 wherein said handle includes a flat abutment surface adapted to abut a verifier attached to a dome cover of the railcar dome when the ring protector is at the opened position.

5. The ring protector as claimed in claim 1 wherein the ring protector defines four approximately equally spaced access holes.

6. The ring protector as claimed in claim 1 wherein the ring protector has a plurality of equally spaced handles.

7. The ring protector as claimed in claim 6 wherein each of the plurality of handles includes a flat abutment surface adapted to abut a verifier attached to a dome cover of the railcar dome when the ring protector is at the opened position.

8. A railcar dome assembly comprising:

a manway cover;

a dome ring situated on top of the manway cover, said dome ring defines a number of approximately equally spaced dome port openings;

a dome lid pivotable mounted to said dome ring, said dome lid adapted to pivot between an opened position and a closed position;

a ring protector located radially inwardly of said dome ring, said ring protector defines a number of approximately equally spaced access holes, said ring protector rotatable between an opened position in which each of the dome port openings is in-line with one of the access holes and a closed position in which each of the port openings is not in-line with one of the access holes.

9. The railcar dome assembly as claimed in claim 8 wherein the number of approximately equally spaced dome port openings is equal to the number of approximately equally spaced access holes.

10. The railcar dome assembly as claimed in claim 8 wherein said ring protector further includes a handle extending axially outwardly.

11. The railcar dome assembly as claimed in claim 10 further comprises a verifier extending from said dome lid, said verifier positioned such that the handle abuts said verifier to prevent the dome lid from pivoting to the closed position if the protector ring is at the opened position.

12. The railcar dome assembly as claimed in claim 8 further comprises a verifier extending from said dome lid, said ring protector further includes an abutment surface, said verifier and abutment surface positioned such that the abutment surface abuts said verifier to prevent the dome lid from pivoting to the closed position if the protector ring is at the opened position.

13. The railcar dome assembly as claimed in claim 8 wherein said protector ring has a tab extending radially inwardly, a plurality of circumferentially and equally spaced bolts extends from said manway cover, said tab situated between two of said bolts to prevent said protector ring from rotating.

14. A bracket assembly for a railcar dome assembly, said bracket assembly comprises a pivot bracket having a multi-axis hole defined therein.

15. The bracket assembly as claimed in claim 14 wherein said multi-axis hole has three circular axis.

16. The bracket assembly as claimed in claim 14 further comprising a latching bracket having a multi-axis hole defined therein.

17. The bracket assembly as claimed in claim 16 wherein said multi-axis hole of said latching bracket has three circular axis.

18. The bracket assembly as claimed in claim 16 wherein said pivot bracket and said latching bracket are identically shaped.

19. A method for preventing unauthorized access through a dome port opening of a railcar dome, said method comprising the steps of:

providing a ring protector having a plurality of equally spaced access holes defined therein;

rotating said ring protector from an opened position in which each of the dome port openings is in-line with one of the access holes to a closed position in which each of the port openings is not in-line with one of the access holes.

20. The method as claimed in claim 18 further comprising the step of moving the ring protector axially a given distance prior to rotating the ring protector from the opened position to the closed position.

* * * * *